US007021755B2

(12) United States Patent
Ogura et al.

(10) Patent No.: US 7,021,755 B2
(45) Date of Patent: Apr. 4, 2006

(54) PRINTING APPARATUS

(75) Inventors: Hideki Ogura, Kanagawa (JP); Hiroyuki Ishinaga, Tokyo (JP); Ryoji Inoue, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/671,522

(22) Filed: Sep. 29, 2003

(65) Prior Publication Data

US 2004/0061761 A1 Apr. 1, 2004

(30) Foreign Application Priority Data

Sep. 30, 2002 (JP) ..... 2002-287831

(51) Int. Cl.
*B41J 13/00* (2006.01)

(52) U.S. Cl. ..... 347/104; 400/625; 400/629

(58) Field of Classification Search ..... 400/624, 400/625, 629; 347/104; 271/212
See application file for complete search history.

(56) References Cited

U.S. PATENT DOCUMENTS 5,248,210 A * 9/1993 Schulz ..... 400/625
5,297,018 A 3/1994 Kashimura
5,409,209 A * 4/1995 Nakamura et al. ..... 271/271
5,538,237 A * 7/1996 Miyauchi ..... 271/117
5,567,068 A * 10/1996 Egashira et al. ..... 400/625
6,152,630 A * 11/2000 Scarton et al. ..... 400/642
6,447,188 B1 9/2002 Ishizaki
2003/0076399 A1* 4/2003 Matsuo et al. ..... 347/104
2003/0132997 A1* 7/2003 Maekawa et al. ..... 347/104

FOREIGN PATENT DOCUMENTS

JP 6-171181 6/1994
JP 2000-44104 2/2000
JP 3152240 1/2001
JP 2001-239662 9/2001

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A small-sized printing apparatus, which is stable in printing operation and high in reliability, is provided, although the installation area and the utility area are small. For this purpose, the conveying direction of a supplied printing medium is reversed generally in the opposite direction, and then guided in the vertical direction. Thus, the printing medium is firmly supported. Also, since the printing medium exists beneath the printing section in the vertical direction during the printing operation, it is possible to prevent the interior of the apparatus from being contaminated with ink dropping down from the printing region.

14 Claims, 9 Drawing Sheets

PRINTING APPARATUS

This application claims priority from Japanese Patent Application No. 2002-287831 filed Sep. 30, 2002, which is incorporated hereinto by reference.

BACKGROUND OF THE INVENTION

1. Field of the Invention

The present invention relates to a printing apparatus for carrying out the printing operation on a printing medium based on image information.

2. Description of the Related Art

Recently, it has been desired that a printing apparatus for outputting an image produced by a host apparatus such as a personal computer be structured to be thin in thickness and small in installation area, to accompany the miniaturization of the personal computer or a display. And, various printing apparatus have already been proposed for achieving such an object.

According to Japanese Patent No. 3,152,240, for example, a small and thin type ink jet printing apparatus is disclosed, which contemplates the portable use and is capable of carrying out the printing operation in a stable manner either in a vertical position or a horizontal position. A characteristic of this printing apparatus disclosed in this specification resides in that when it is used in the vertical position at which the installation area becomes smaller, a printing section including an ink tank and a printing head is located generally at a middle position of a housing as seen in the height direction, while a battery having a heavier weight is disposed beneath the former. As described above, since a particularly heavy part of the constituent elements is disposed in a lower portion of the apparatus body, a center of gravity of the entirety of the printing apparatus also shifts downward, whereby the stable printing is possible even in the vertical position in which the operation is usually liable to become unstable.

According to the above-mentioned structure used in the vertical position disclosed in the Japanese Patent No. 3,152,240, however, in practical use, the space saving is not achieved as expected if a paper-conveying space is taken into account, because the paper-feeding and discharging are carried out in a place extending in the horizontal direction from both sides of the printing apparatus relative to the installation plane. Also, according to the above specification, it is recommended that the printing in the vertical position is basically carried out on a stiff printing medium such as a postcard or a thick paper, while plain paper, for example, of A4 size, which is mainly used in the printing apparatus, is preferably printed in the horizontal position. As described above, the apparatus disclosed in Japanese Patent No. 3,152,240 originally conveys the printing medium in the horizontal direction but may be used in the vertical position if it must be located in a small installation area. Accordingly, although it could carry out the printing on an A4 size paper in the vertical position, it is expected in such a case that the printing medium hangs down or deforms on both sides of the printing apparatus, resulting in the unstable printing.

According to Japanese Patent Application Laying-open No. 2000-044104, a structure is disclosed, in which printing media prior to being printed and after being printed are stacked and accommodated, respectively, generally in the vertical position for lessening the installation area of the printing apparatus to save space.

Further, according to Japanese Patent Application Laying-open No. 2001-239662, a structure for saving a space is also disclosed, in which a body of a printing apparatus is used while being fixed to a stationary object such as a wall or a desk. A characteristic of the printing apparatus disclosed in the description of this patent publication is that a paper-feeding tray for storing a stack of non-printed printing media therein and a paper-discharging tray for accommodating the printed media therein are connected via a flexible conveying path. The paper-feeding tray and the paper-discharging tray are movable relative to each other so that both the trays are disposed at various relative angles in accordance with the environment in which the printing apparatus is used if space is limited.

However, the object of Japanese Patent Application Laying-open Nos. 2000-044104 and 2001-239662 is to save an installation space for the printing apparatus containing areas for accommodating the printing media both before and after being printed, respectively. Accordingly, an aspect point for realizing the space saving does not reside in the printing section itself, but in the positional relationship between the paper-feeding tray and the paper-discharging tray, and therefore, attention is hardly paid to the space saving of the printing section. Thus, since these prior art apparatuses do not exhibit their desired effect when a number of printing media are loaded on the printing apparatus, it is thought that these printing apparatuses are unsatisfactory from the standpoint of the miniaturization of a personal-use apparatus. Particularly, in one embodiment of Japanese Patent Application Laying-open No. 2000-044104, since the paper-feeding region and the paper-discharging region are arranged parallel to each other in the depth direction of the printing apparatus, a thickness of the apparatus body increases in the depth direction. In a modification of the embodiment in this patent publication, there is a structure in which the paper-feeding region and the paper-discharging region are arranged above and below the printing section, respectively. In such a case, a height of the apparatus must be twice a vertical dimension of the printing medium or more, whereby the center of gravity of the apparatus body is at a high position to cause the printing apparatus to be unstable as a whole.

Generally speaking, in the personal use environment in which the individual user usually operates the printing apparatus, it is unnecessary to always store a large amount of printing media in the apparatus body, but in most cases, it will be sufficient that only a relatively small number of printing media is replenished every time when required. Accordingly, attention for the space saving should be paid not only to the capacity of the paper-feeding tray, and the paper-discharging tray but also to the entirety of the printing section containing the paper-feeding path and the paper-discharging path. To save the space for the printing section, it is desired that the conveying direction of the printing medium is as vertical as possible to the installation plane of the printing apparatus, as well as both of the paper-feeding and the paper-discharging are carried out on the same side. In this regard, Japanese Patent Application Laying-open No. 6-171181 (1994) discloses a structure relatively suitable for space saving.

According to Japanese Patent Application Laying-open No. 6-171181 (1994), a structure of a printing apparatus is disclosed, in which a printing head is disposed inside of a conveying path for a printing medium to supply the printing medium from an upper side and deliver the same to the upper side again.

FIG. 1A is a schematic sectional view of the structure of the printing section disclosed in Japanese Patent Application Laying-open No. 6-171181 (1994) for the purpose of comparing the same with the inventive structure described later. In FIG. 1A, the printing medium is fed downward from an upper right position in the direction shown by an arrow. Thereafter, the printing medium is brought into tight contact with a reversal roller 101, and as the reversal roller 101 rotates, the conveying direction is converted upward. The printing operation is carried out on the printing medium conveyed upward by a printing head 102 disposed inside of the conveying path. Since the printing head 102 is located inside of the conveying path; i.e., between the paper-feeding path running downward and the paper-discharging path running upward, a size h of the printing head 102 is hardly relevant to an installation width W of the printing apparatus. The installation width W of the printing apparatus is determined by a total value of a diameter of the reversal roller 101 and a conveying space necessary for the feeding and discharging of the printing medium. Further, it can be said regarding the stability of the apparatus body that a structure, in which the reversal roller 101 having a relatively heavy weight is disposed at the lowermost end of the vertical type printing apparatus having a narrow installation area, is preferable.

In recent small-sized printing apparatuses, an ink jet system has been often employed as a printing system since the saving of the production cost is possible due to its relatively simple structure. In the above-mentioned Japanese Patent Application Laying-open No. 6-171181 (1994), the printing head 102 is positioned substantially just above the reversal roller 101. Accordingly, there is a risk in that if an ink droplet drops from the ink jet printing head, the reversal roller 101 may be contaminated thereby. Such contamination causes ink to be transferred to sequentially feed printing media, and deteriorates the quality of output image.

Also, since a printing plane is liable to be unstable due to the weight of the printing medium, it is desirable to apply a suitable tension to the printing medium in the vicinity of the printing plane. However, with reference to FIG. 1A again, in the above-mentioned Japanese Patent Application Laying-open No. 6-171181 (1994), part of the conveying path for the printing medium from the reversal roller 101 to the printing section extends substantially in the vertical direction with no means for supporting the printing medium to keep its vertical position. Further, since a contact area of the printing medium with the reversal roller 101 is as small as within a lower half region of the reversal roller 101, the effect of the reversal roller 101 itself and the frictional force generated between the printing medium and the reversal roller 101 are not useful for the purpose of supporting the printing medium from below.

In addition, according to the structure disclosed in the above-mentioned Japanese Patent Application Laying-open No. 6-171181 (1994), since a surface of the printing medium passing by the printing head, onto which ink is freshly adhered, is placed on another printing medium already discharged, there is a risk that the printing medium is contaminated or the printed image is deteriorated.

SUMMARY OF THE INVENTION

The present invention has been made to solve the above-mentioned problems in the prior art, and an object thereof is to provide a small-sized printing apparatus capable of carrying out stable and reliable printing operation in spite of having a reduced installation area and a smaller net operational area.

Another object of the present invention is to provide a structure of a small-sized portable type ink jet printing apparatus.

In the first aspect of the present invention, there is provided a printing apparatus for introducing a printing medium from a first printing medium holding region and discharging a printing medium after being printed to a second printing medium holding region disposed above the first printing medium holding region, comprising:

paper-feeding means for conveying the printing medium from the first printing medium holding region, reversal means for reversing the conveying direction of the printing medium conveyed by the paper-feeding means generally in the reverse direction, deflection means for deflecting the conveying direction of the printing medium reversed by the reversal means upward generally in the vertical direction at the operating position, means for holding printing means to perform a printing on the printing medium of which the conveying direction is deflected generally upwardly in the vertical direction, and paper-discharging means for discharging the printing medium on which the record is printed by the printing means to the second printing medium holding region.

In the second aspect of the present invention, there is provided a printing apparatus for introducing a printing medium from a first printing medium holding region and discharging a printing medium after being printed to a second printing medium holding region disposed below the first printing medium holding region, comprising:

paper-feeding means for conveying the printing medium from the first printing medium holding region, deflection means for deflecting the conveying direction of the printing medium conveyed by the paper-feeding means downward generally in the vertical direction at the operating position, means for holding printing means to perform a printing on the printing medium of which the conveying direction is deflected generally downwardly in the vertical direction, reversal means for reversing the conveying direction of the printing medium on which the record has been printed to the direction toward a position at which the second printing medium holding region is located after being drawn generally in the direction opposite to the position at which the second printing medium holding region is located, and paper-discharging means for discharging the printing medium in a direction that has been deflected to the position at which the second printing medium holding region is located, into the second printing medium holding region.

In the third aspect of the present invention, there is provided an image-forming apparatus for printing on a printing medium by using an ink jet printing head, comprising a paper-feeding tray disposed on a first side of a body of the image-forming apparatus while stacking the printing media therein at a slanted position so that a portion of the tray closer to the apparatus body is relatively lower, a pickup roller for feeding the printing medium stacked in the paper-feeding tray, a reversal path for reversing the printing medium fed by the pickup roller by guiding the printing medium closer to a second side opposite to the first side, and then guiding closer to the first side, a conveying path for guiding the printing medium guided along the reversal path generally upwardly in the vicinity to the first side, holding means for holding the ink jet printing head above the reversal path so that the printing operation is carried out on a surface of the printing medium opposite to another surface opposite to the first side, a paper-discharging tray disposed above the paper-feeding tray on the first side, and capable of stacking the printing media, and a discharging roller for discharging the printing medium on which the printing has been effected by the ink jet printing head to the paper-discharging tray.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described more concretely below with reference to the attached drawings.

First Embodiment

Figure 2:
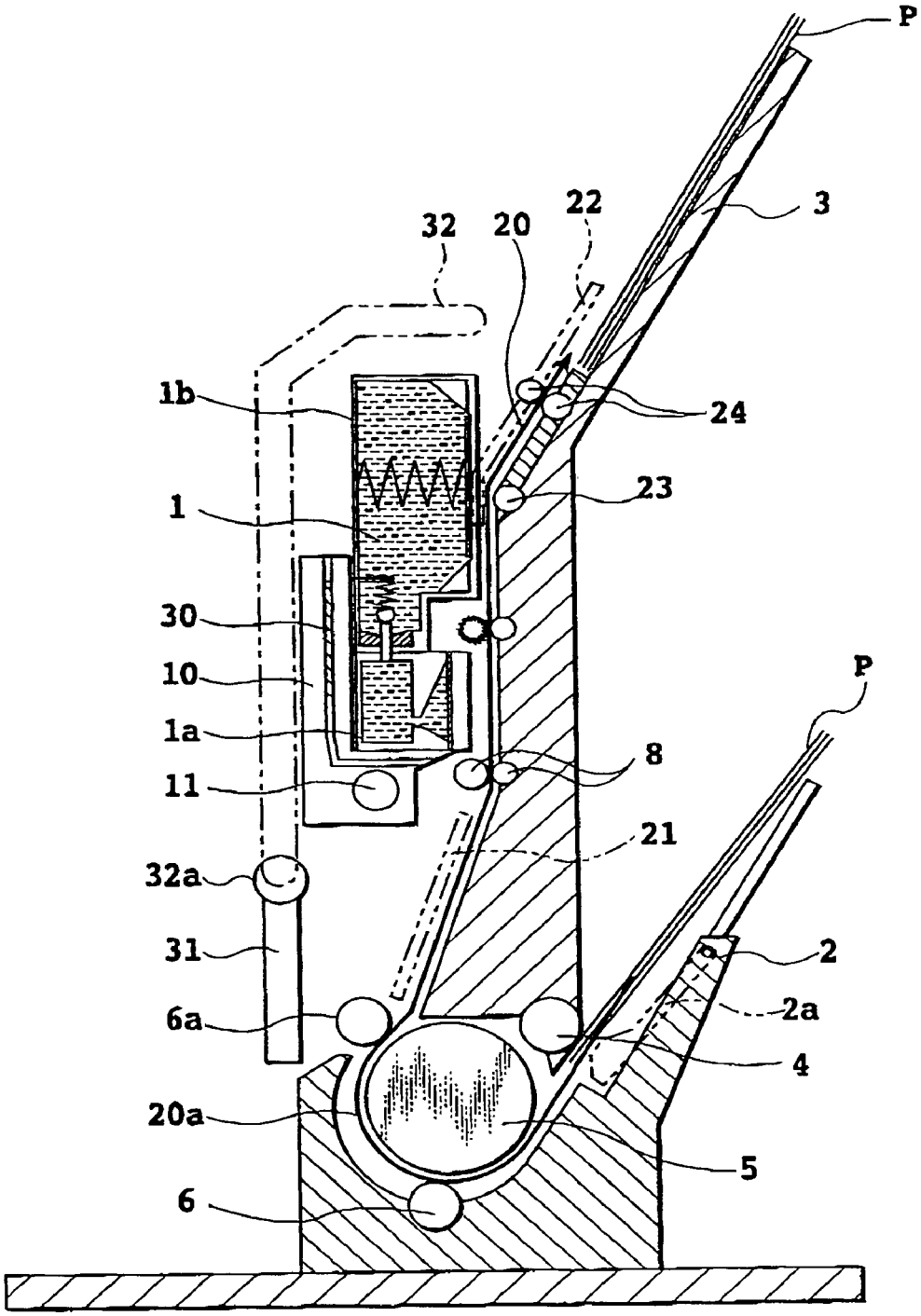
FIG. 2 is a sectional view of an ink jet printing apparatus to which the first embodiment of the present invention is applied.

FIG. 2 is a schematic sectional view of an ink jet printing apparatus to which a first embodiment of the present invention is applied.

In FIG. 2, reference numeral 2 denotes a paper-feeding tray for feeding a printing medium, and 3 denotes a paper-discharging tray for discharging the printing medium after being printed. All members other than the two trays are accommodated within a generally parallelepiped-shaped body of the printing apparatus. In this embodiment, a printing medium P is conveyed along a conveying path shown by an arrow from the paper-feeding tray 2 located beneath the apparatus body to the paper-discharging tray 3 located above the apparatus body. After the printing medium has been reversed, the printing medium is generally in the vertical position relative to the installation plane, and the printing is carried out on the printing medium by a printing section 1 disposed above the apparatus body while maintaining this position.

According to this embodiment, the conveying path may be divided into four stages; that is, an initial stage, a paper-feeding stage, a printing stage and a paper-discharging stage. Each of the stages will be sequentially described below.

FIGS. 3A to 3D are sectional views of the apparatus body for respectively illustrating the sequential stages of the printing operation of this embodiment.

Figure 3A:
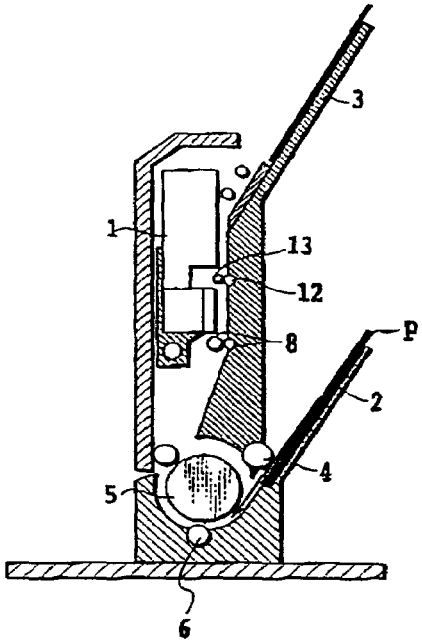
FIGS. 3A to 3D are sectional views for explaining the respective steps of the printing operation in the ink jet printing apparatus to which the first embodiment of the present invention is applied.

FIG. 3A shows the initial stage of the printing operation. The printing media P in a stack placed on the paper-feeding tray 2 are drawn into the printing apparatus while being separated one by one by a pickup roller 4.

Figure 3B:
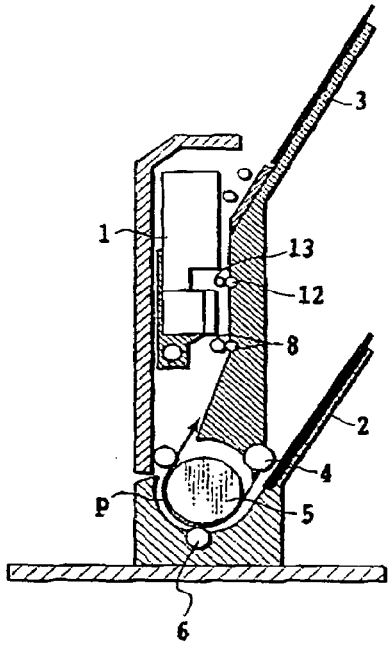

FIG. 3B shows the paper-feeding stage. The conveying direction of the printing medium P is reversed by the rotation of a reversal roller 5 while being in tight contact with the reversal roller 5 by the nip between the reversal roller 5 and an auxiliary roller 6 adjacent to each other. The printing medium P reversed in the conveying direction is conveyed to the printing region along a slanted surface of the interior of the apparatus body.

Figure 3C:
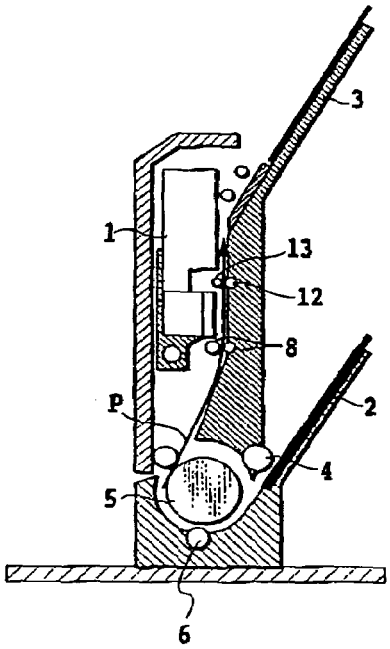

FIG. 3C shows a state in which the printing medium P is being conveyed into the printing region.

Figure 4:
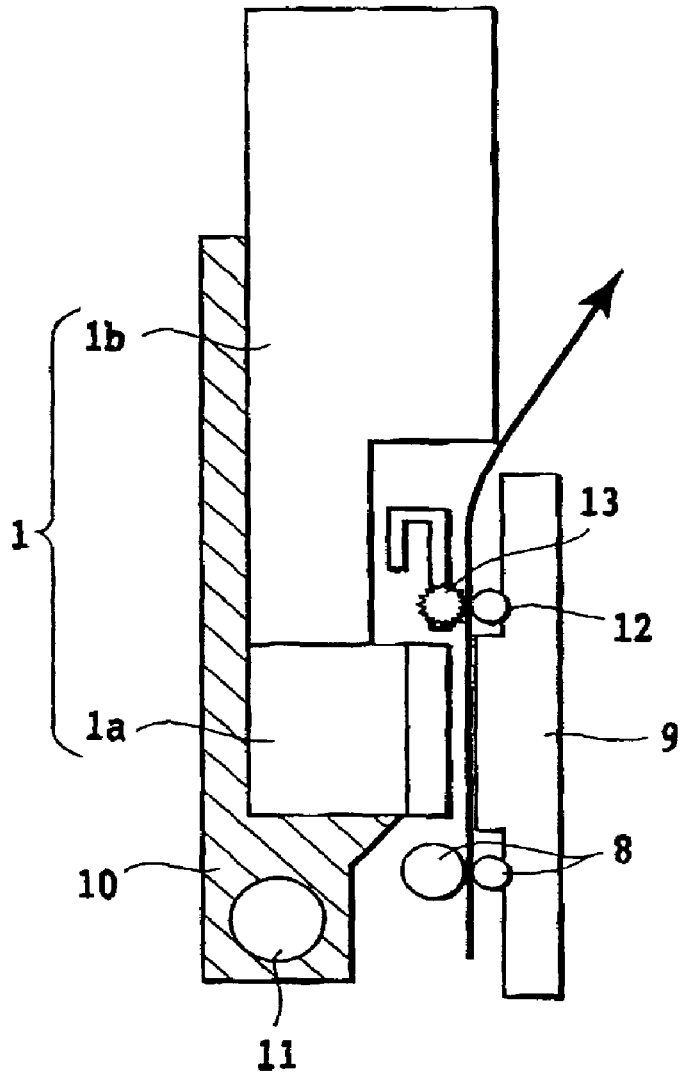
FIG. 4 is an enlarged sectional view to which the first embodiment of the present invention is applied.

FIG. 4 is a sectional view for explaining the printing region of this embodiment in more detail. A process in the printing region will be described with reference to both of FIGS. 3C and 4.

The printing medium P, having a conveying direction converted upward by the reversal roller 5, runs along the slanted surface in the interior of the apparatus body and reaches a pair of paper-feeding rollers 8. The conveying direction of the printing medium P is further converted by the pair of paper-feeding rollers 8 and moves while being regulated by a platen 9 disposed opposite to the printing section 1 to maintain its printing plane constant. Thereafter, the printing medium P passes through a nip between a paper-discharging roller 12 and an auxiliary roller 13 and is conveyed to the paper-discharging region. In an area along the platen 9, the printing medium P is supported by the paper-feeding rollers 8 and the paper-discharging roller 12, and maintained generally in the vertical position relative to the installation plane of the printing apparatus, at which position the printing operation is carried out by the printing section 1. In this regard, the auxiliary roller 13 is formed as a spur roller for the purpose of reducing a contact area with the surface of the printing medium on which the printing with ink has been carried out. Hereinafter, this roller is referred to as a spur roller 13.

With reference again to FIG. 2, reference numeral 4 denotes a pickup roller for feeding the printing medium stacked on the paper-feeding tray 2. Reference numeral 2*a* denotes a frictional separating pad for inhibiting the feeding of the printing media other than the printing medium in contact with the pickup roller 4 and applied with a feeding force.

The printing medium P fed by the pickup roller 4 is conveyed on a reversal path 20*a*, which is part of the conveying path 20, by the reversal roller 5. Reference numerals 6 and 6*a* denote pinching rollers for pressing the printing medium P to the reversal roller 5. Reference numeral 22 denotes a discharging guide plate for guiding the printing medium on which an image is printed to the paper-discharging tray 3, and 23 denotes a guide roller for guiding the printing medium P at a position opposite to the discharging guide plate 22. Reference numeral 30 denotes a circuit board provided in a carriage 10 as means for holding the printing head.

An openable cover 32 is provided as part of an outer case 31 of an apparatus housing and is rotatable about a hinge 32*a*. The openable cover 32 is opened and closed when the maintenance and/or replacement of the carriage 10, the printing head 1*a* and an ink tank 1*b* are carried out.

The printing section 1 in this embodiment is constituted by the printing head 1*a* for carrying out the ink jet printing operation and the ink tank 1*b* for supplying ink to the printing head 1*a*. In the printing head 1*a*, a plurality of printing elements for ejecting ink are arranged, the arrangement direction of which is parallel to the conveying direction of the printing medium. Reference numeral 10 denotes the carriage reciprocating along a guide shaft 11 in the vertical direction relative to the drawing, while carrying the printing section 1 thereon. Since the printing apparatus of this embodiment is a serial type ink jet printing apparatus, the image formation of the printing medium is carried out by sequentially repeating a main print scanning motion for moving the carriage 10 while ejecting ink from the respective printing elements on the printing head 1*a* and a conveyance of the printing medium P along the conveying path at a predetermined distance.

Figure 3D:
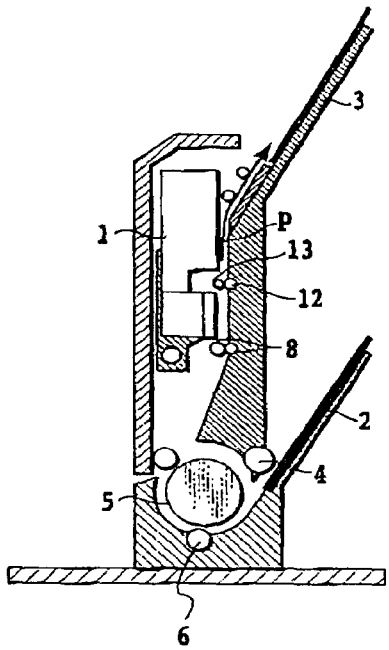

FIG. 3D illustrates the discharging of the printing medium P. The printing medium P after being printed in the printing section 1, passes through a nip between the paper-discharging roller 12 and the spur roller 13 associated therewith and is conveyed to the paper-discharging tray 3. The paper-discharging tray 3 is adapted to sequentially receive the printing media after being printed to form a stack. In this regard, with reference to FIG. 2, a lower end of the paper-discharging tray 3 of this embodiment is located at a position lower in the vertical direction than the conveying path on which the printing medium is finally discharged as shown by an arrow. According to this arrangement, the sequentially discharged printing media are smoothly stacked on the paper-discharging tray.

A series of steps relating to the printing operation has been described above.

According to this embodiment, the printing section 1 is disposed within a parallelepiped-shaped area encircling the respective members while being outside of and close to the conveying path for feeding and discharging the printing medium from a right side as seen in the drawing. This means that the same space-saving effect is obtained as in Japanese Patent Application Laying-open No. 6-171181 (1994).

Figure 1A:
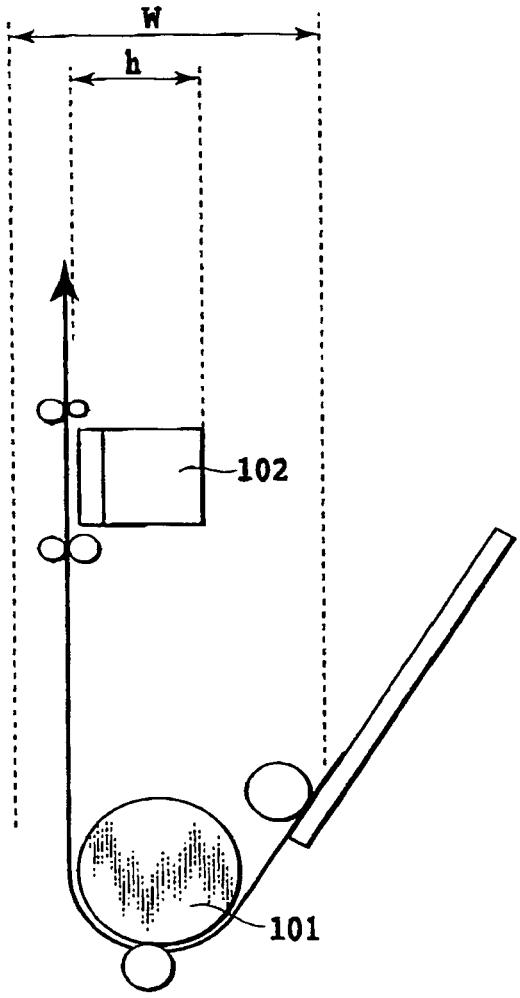
FIGS. 1A and 1B are schematic illustrations of a printing apparatus for comparing a first embodiment of the present invention with the prior art.
Figure 1B:
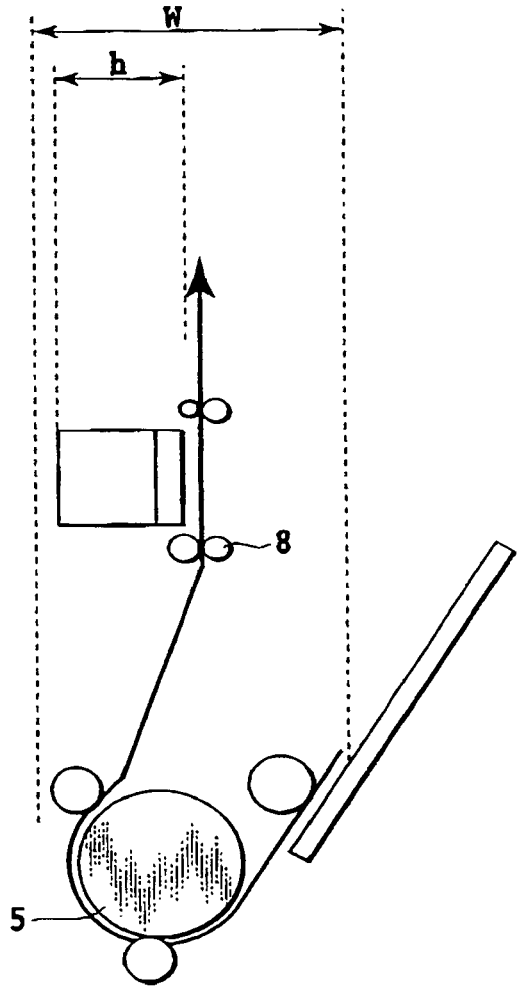

FIG. 1B illustrates the above-mentioned effect of the present invention while comparing the same with Japanese Patent Application Laying-open No. 6-171181 (1994). With reference to FIG. 1A, according to the arrangement of the patent publication, the conveying direction of the path of the printing medium is not significantly changed except for the deflection due to the reversal roller 101. To minimize the influence of a size h of the printing head 102 on the installation area, the printing head 102 is disposed generally at a position immediately above the reversal roller 101 within the U-shaped conveying path. However, in this case, it should be noted that the space saving is not directly achieved by disposing the printing head inside of the conveying path, but by disposing the printing head generally directly above the reversal roller. The present inventors have noticed this point and solved the problem involved in Japanese Patent Application Laying-open No. 6-171181 (1994), while disposing the printing head generally directly above the reversal roller.

As shown in FIG. 1B, according to this embodiment, there is a characteristic in that the conveying path of the printing medium reversed by the reversal roller 5 is further deflected by a paper-feeding roller 8 located closer to the paper-feeding side (rightward in the drawing). By this arrangement, the printing medium is interposed between the printing section 1 and the reversal roller 5. Accordingly, even if an ink droplet drops from the printing head of an ink jet type, the ink droplet is absorbed by the printing medium to minimize a risk of contamination of the reversal roller 5 and the subsequent printing medium. Also, in comparison with the arrangement shown in FIG. 1A, since an area of the printing medium in tight contact with the reversal roller 5 increases, a frictional force generated between both becomes greater. The printing medium is conveyed while being wrapped 90 degrees or more around a surface of the reversal roller 5, preferably 180 degrees or more. Further, since the printing medium is conveyed while the weight of the printing medium is supported at many points, e.g., an upper portion of the reversal roller, a slanted surface in the interior of the apparatus and the paper-feeding roller, the printing medium is more stabilized in the printing section.

With reference again to FIG. 2, according to this embodiment, since the printing section 1 is outside of the printing medium conveying path, the printing medium is discharged onto the paper-discharging tray 3 while opposing the printed surface on which ink is adhered. Thus, since the printed surface on which ink has just been adhered is not brought into contact with another printing medium already discharged, there is less risk, even if the ink is insufficiently dried, that the printing media contacted with each other are contaminated and the image just printed is damaged.

In contrast with a case in which the printing section is inside the conveying path as shown in FIG. 1A, the maintenance of the printing section and the replacement of the ink tank are smoothly carried out without removing the paper-feeding tray 2, the paper-discharging tray 3 or other components.

As described above, while comparing FIGS. 1A and 1B with each other, according to the present invention, it is possible to achieve a further effect by employing an arrangement different from Japanese Patent Application Laying-open No. 6-171181 (1994), while maintaining the effect resulting therefrom.

In this embodiment, since a paper-feeding section capable of stacking the printing media and a printing medium conveying mechanism having a relatively heavy weight are located on the bottom side, the center of gravity of the apparatus body exists at a lower position. Therefore, stability is achievable with less in risk of falling even if the printing apparatus has a large height relative to the installation area as in this embodiment.

By arranging the printing elements in the ink jet printing head in the vertical direction relative to the installation plane of the printing apparatus so that ink is ejected in the horizontal direction as in this embodiment, the effect of a chip size of the printing head (that is, a size of the arrangement plane for the printing elements) on the installation area for the apparatus body is minimized. Therefore, even if the chip size becomes larger in the future in correspondence with increasing speed of the printing operation and increasing image quality, it is possible to accommodate the chip without increasing the installation area. Further, in the printing region, not only the chip size but also mechanism parts such as the paper-feeding roller 8 or the spur roller 13 largely influence a width of the printing region. Accordingly, the printing region is preferably disposed in the vertical direction relative to the installation plane also for the purpose of suppressing such an influence. In addition, in the ink tank 1*b* for supplying ink to the printing head 1*a*, a width and a thickness thereof are minimized as much as possible, while a height thereof increases so that a predetermined amount of ink is stored in the ink tank. By disposing the ink tank 1*b* above the printing head 1*a*, the space saving of the installation area is realized while suppressing the width of the printing section itself.

An example of the printing head 1*a* and the ink tank 1*b* described above will be briefly explained below.

In an ink tank of a conventional ink jet printing apparatus, an absorbent such as sponge is provided as a member for generating negative pressure. By holding ink to be absorbed in the absorbent, it is possible to generate a suitable negative pressure in the printing head. Due to such a negative pressure, it is possible to suitably continue the supply of ink to the printing head and realize the stable ink ejection from the printing elements. However, the employment of an absorbent such as a sponge provided in the ink tank or an ink supplying system is contradictory to the goal of miniaturization of the printing apparatus, because the size or shape of the ink tank is restricted thereby. Also, this may cause an obstruction against the stable supply of a large amount of ink per unit time for the purpose of high-speed printing and highly precise printing, which are recent requirements in this field.

Figure 5:
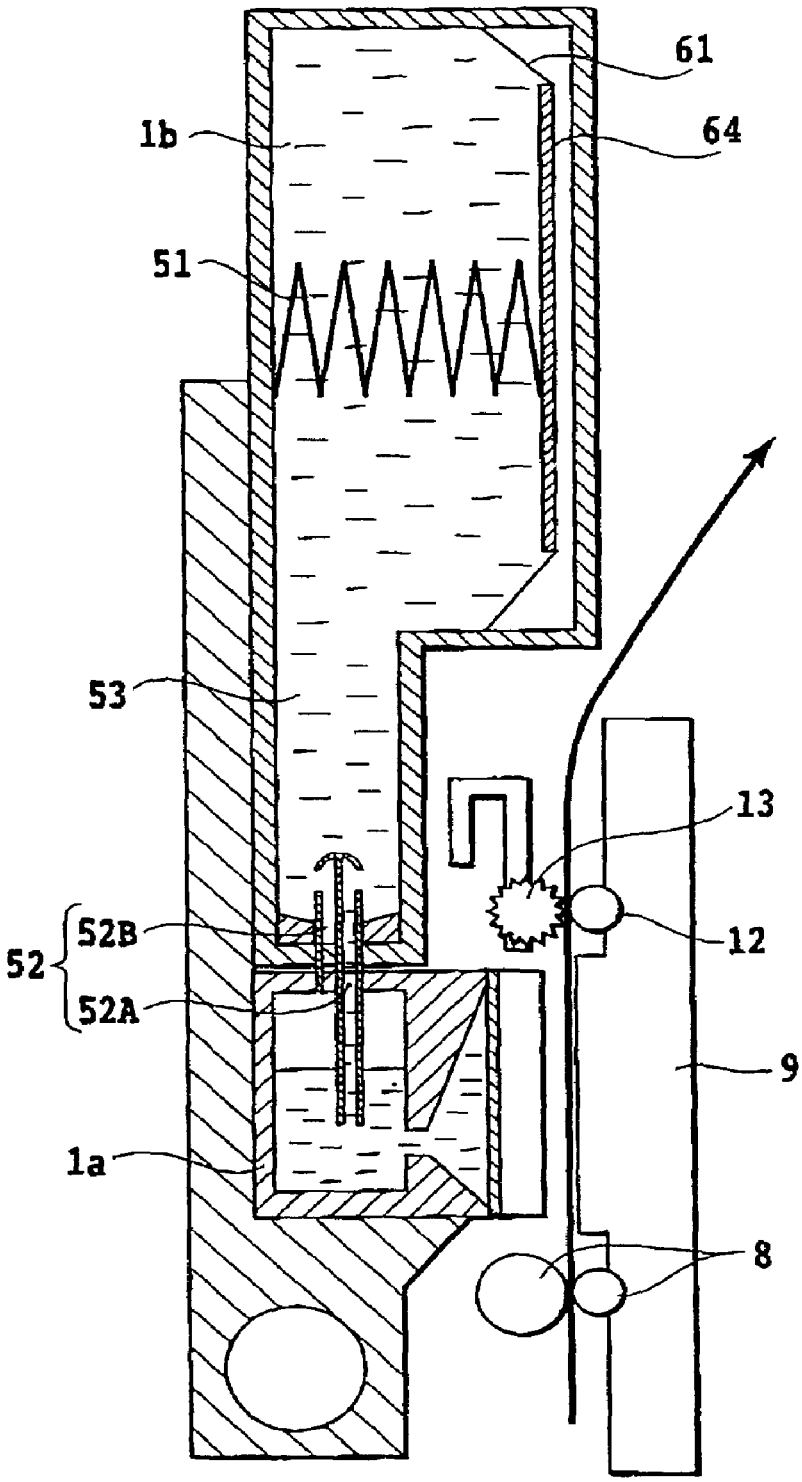
FIG. 5 is a structure of a printing section applicable to the first embodiment of the present invention.

FIG. 5 shows an ink supplying system for solving the above problems, including a printing head 1*a* and an ink tank 1*b* for supplying ink thereto, applicable to this embodiment. In FIG. 5, the ink tank 1*b* is provided in the interior thereof with a flexible sheet member 61, a plate member 64 movable in the horizontal direction in the drawing while suppressing the deformation of the flexible sheet member 61, and a spring 51 for biasing the plate member 64 in the direction (rightward in the drawing) in which an ink-storage space defined by the flexible sheet member 61 is enlarged. A suitable negative pressure is applied to the printing head 1*a* due to the bias of the spring 51, and equilibrates with a holding force of a meniscus formed in the nozzle, whereby the meniscus is maintained at a favorable position. In this embodiment, the above-mentioned arrangement operates as means for generating a negative pressure in place of the absorbent.

A joint portion 52 coupling the ink tank 1*b* with the printing head 1*a* is provided with a hollow needle-like member having its interior divided in the axial direction into two parts to define two flow paths. The two flow paths in an upper portion of the needle-like member, that is, those located in the ink tank 1*b*, open at substantially the same height, respectively (hereinafter referred to as tank side opening positions), in the vertical direction. On the other hand, the two flow paths in a lower portion of the needle-like member, that is, those located in the printing head 1*a*, open at different heights, respectively (hereinafter referred to as head side opening positions). In the drawing, the flow path in which the head side opening is lower than the other in the vertical direction (the right flow path) is referred to as an ink flow path 52A, while the flow path in which the head side opening is higher than the former in the vertical direction (the left flow path) is referred to as an air flow path 52B. According to the joint portion 52 thus formed, ink is supplied to the printing head 1*a* from the ink flow path 52A in accordance with a balance among a pressure due to a head difference from a position of an ink surface or level in the ink tank 1*b* to an ink meniscus formed at the head side opening position in the air flow path 52B, a pressure due to a head difference from the position of an ink surface or level in the ink tank 1*b* to a position of an ink surface in the printing head 1*a*, and a pressure due to the ink meniscus, while gas is discharged from the air flow path 52B to the ink tank 1*b*, whereby a gas-liquid exchange is quickly carried out between both. In this regard, the ink flow path 52A and the air flow path 52B are so named because liquid and gas are primarily conveyed through the respective flow paths during the gas-liquid exchange, but these flow paths are not exclusive to the respective fluids in any cases.

Since the volume of the tank directly reflects the capacity of ink to be stored in a case of the above structure in which no absorbent such as sponge exists in the ink tank, it is unnecessary to excessively enlarge the ink tank, and the shape of the tank can be relatively freely designed. Therefore, the printing section 1 in which the printing head 1*a* and the ink tank 1*b* are coupled together may be relatively easily realized to be accommodated within a width of the reversal roller 5. Of course, the arrangement shown in FIG. 5 is not indispensable, but the effect of this embodiment is unchanged when an ink absorbent such as sponge may be accommodated in the tank.

Figure 6:
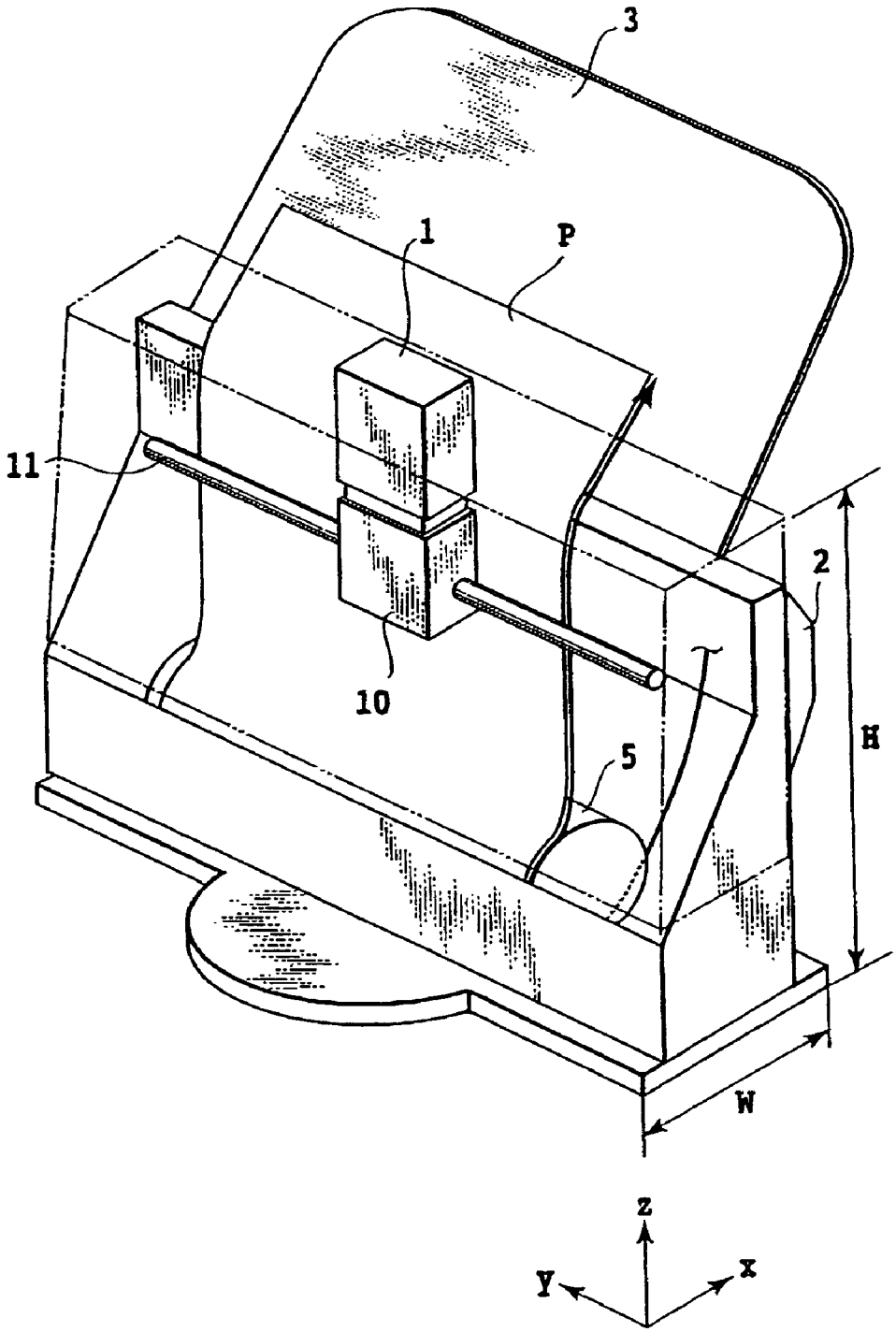
FIG. 6 is a perspective view of the ink jet printing apparatus to which the first embodiment of the present invention is applied.

FIG. 6 illustrates a perspective view of a body of the printing apparatus according to this embodiment from which an outer case is removed. According to the above-mentioned arrangement, the apparatus body is more compact than the conventional one. In FIG. 6, all the constituent members other than the paper-feeding tray 2 and the paper-discharging tray 3 are accommodated within a generally parallelepiped-shaped outer case member. A short side length (in the X direction: W) of an installation plane of a rectangular shape is dependent on a diameter of the reversal roller 5 necessary for reversing the printing medium, and is 100 mm or less even if it is expected that a relatively stiff printing medium such as gloss paper or coated paper is conveyed. A height of the parallelepiped (in the Z direction: H) must be at most 400 mm obtained from a long side length of A4-size paper (about 300 mm) plus the diameter (100 mm) of the reversal roller. Since the paper-feeding tray 2 and the paper-discharging tray 3 are disposed so that they are overlapped viewing from the top in the upward/downward direction on the same side relative to the printing section 1, the handling of the printing media can be carried out on the same side (a rear side in FIG. 6). This results in substantial space saving of the using area of the apparatus body. In this regard, an angle of the respective tray to the installation plane is preferably 45° or more at which a vertical projected image of a long side of the A4-size paper on the installation plane is equal to a short side of the A4-size paper or less. Further, according to FIG. 6, since the printing section 1 is located at a position in the upper portion of the apparatus body independent from the conveying path, it is expected that the replacement of the ink tank or other components can be easily carried out only by removing an upper outer case or a part thereof.

While the ink tank 1*b* is disposed above the printing head 1*a* for the purpose of making the recording section 1 in the above description compact, this embodiment should not be limited thereto. Even though the ink tank 1*b* is not located directly above the printing head, there is no influence on the installation area of the printing apparatus, provided the printing section is smaller in its width than the diameter of the reversal roller. Also, even if the size of the printing section 1 is larger than the reversal roller, the effect of the present invention for saving the installation area of the apparatus body as much as possible is unchanged, provided the printing section 1 is generally located directly above the reversal roller.

While the above description has been made of the process in which the paper-discharging tray is disposed at a position higher than the paper-feeding tray so that the printing medium is conveyed from below to above, the present invention should not be limited thereto. Even if the printing medium is conveyed in the reverse direction from a position of the paper-discharging tray to a position of the paper-feeding position shown in FIG. 2, the effect of the present invention is unchanged. In this case, the internal structure of the paper-feeding portion and the paper-discharging portion may be suitably changed.

While a serial type ink jet printing apparatus is described as the printing system used in this embodiment, the present invention and this embodiment should not be limited thereto. Even if the printing section 1 is of a heat transfer system rather than the ink jet printing system, or of a line scanning type rather than the serial type, the present invention and this embodiment are applicable.

Second Embodiment

A second embodiment will be described below.

Figure 7:
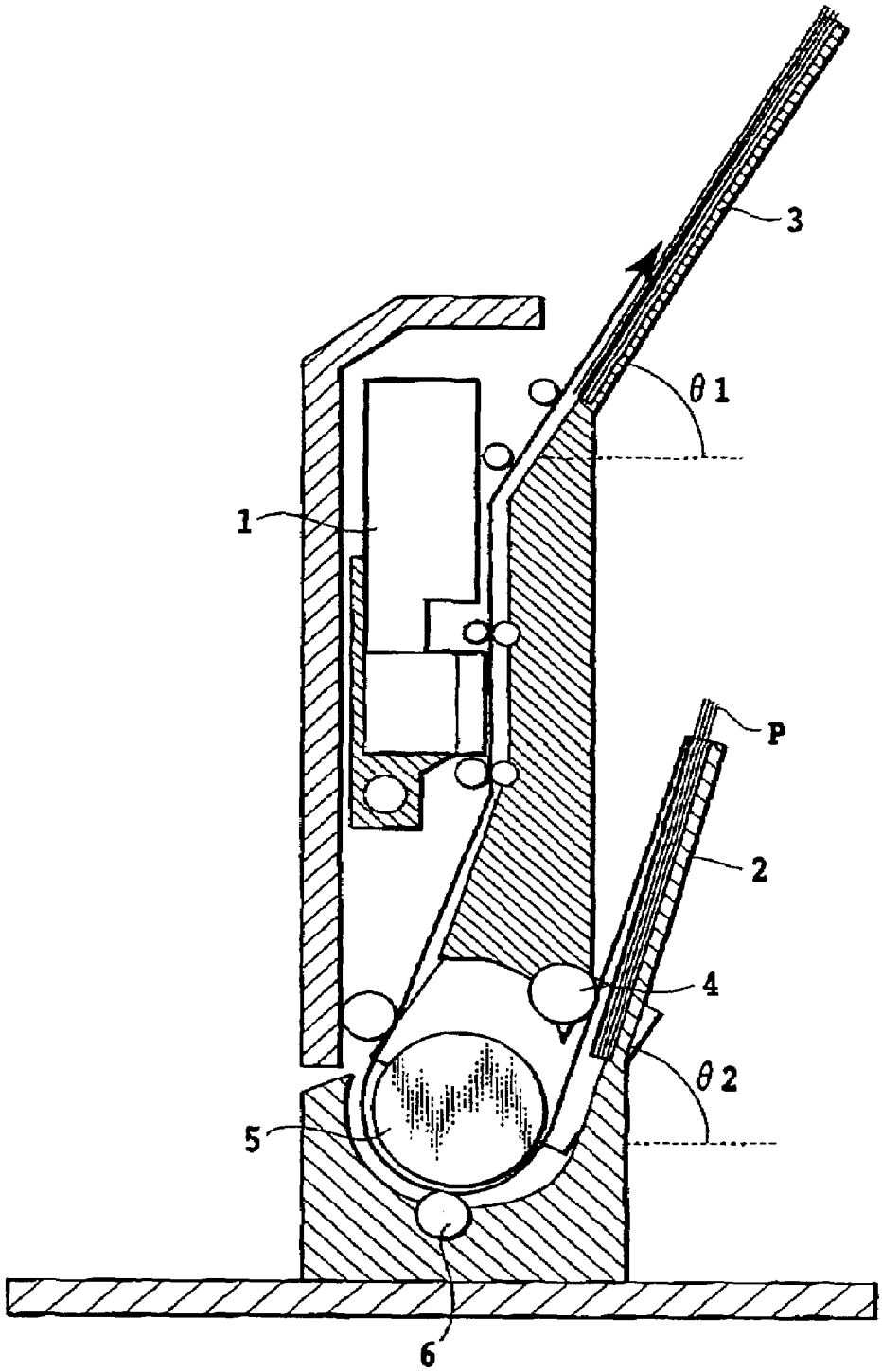
FIG. 7 is a sectional view of an ink jet printing apparatus to which a second embodiment of the present invention is applied.

FIG. 7 is a schematic cross-sectional view of an ink jet printing apparatus applied to this embodiment. Since interior structures in the apparatus body encased by a parallelepiped-shaped outer case in the printing apparatus of this embodiment are the same as those in the first embodiment also, the explanation thereof will not be repeated here. According to this embodiment, angles of two trays (a paper-discharging tray 3 and a paper-feeding tray 2) projected from the apparatus body relative to the installation plane for the apparatus body are different from each other in that the angle $\theta 2$ of the paper-feeding tray 2 is greater than the angle $\theta 1$ of the paper-discharging tray 3 (i.e., $\theta 1<\theta 2$).

By locating the paper-feeding tray 2 within the projected image of the paper-discharging tray 3 disposed above the former, it is possible to enhance the space saving of the overall apparatus body.

Also in this embodiment, the printing medium may be conveyed from a position of the paper-discharging tray to a position of the paper-feeding position so that the printing operation is carried out in the reverse direction, as described with reference to the first embodiment. In this case, the internal structure of the paper-feeding portion and the paper-discharging portion may be suitably changed.

Third Embodiment

A third embodiment will be described below.

Figure 8:
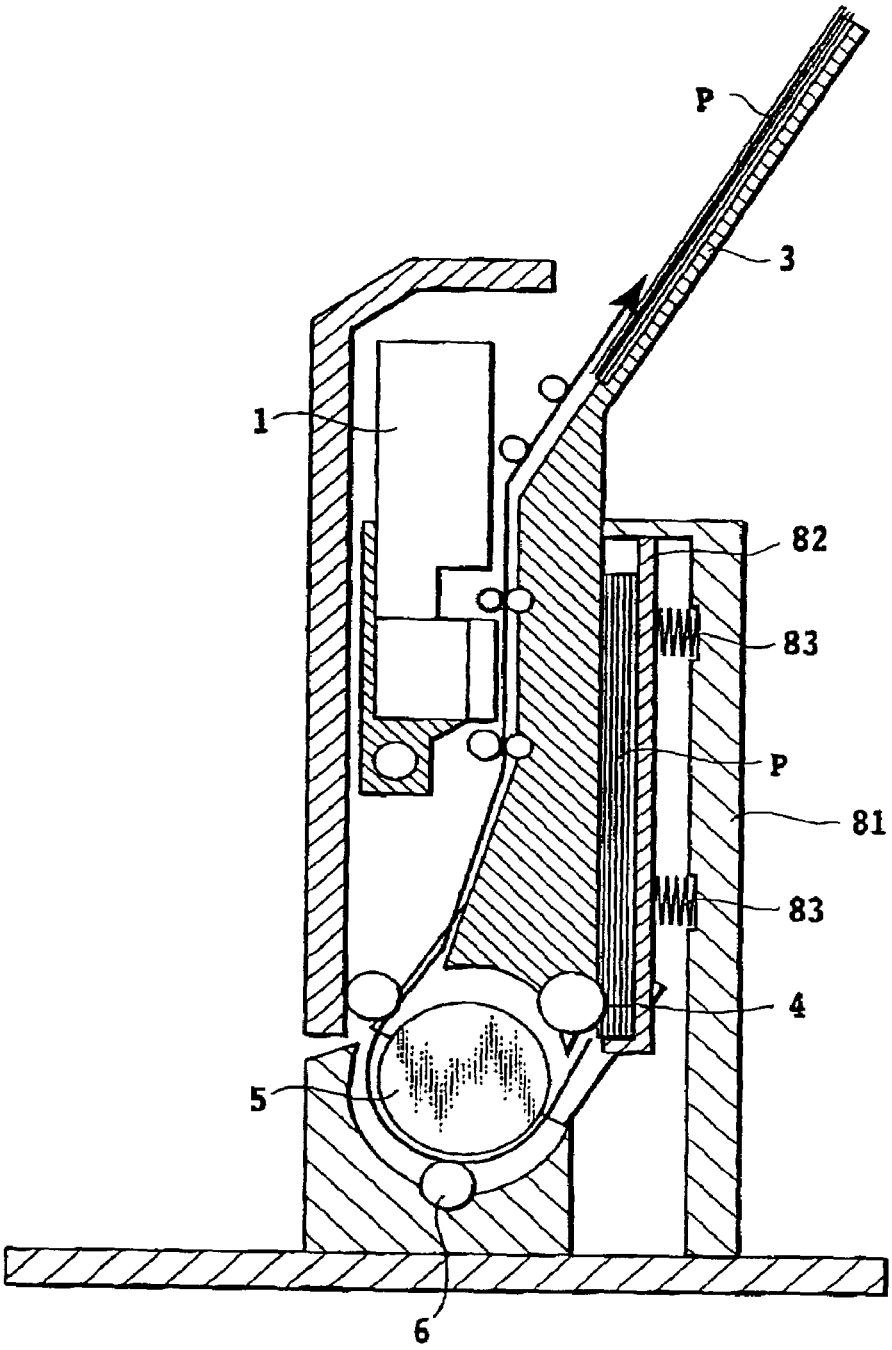
FIG. 8 is a sectional view of an ink jet printing apparatus to which a third embodiment of the present invention is applied.

FIG. 8 illustrates a schematic cross-sectional view of an ink jet printing apparatus applied to this embodiment. Since interior structures in the apparatus body encased by a parallelepiped-shaped outer case in the printing apparatus of this embodiment are also the same as those in the first and second embodiments, the explanation thereof will not be repeated here. A characteristic of this embodiment resides in that the paper-feeding region is disposed in the vertical direction, perpendicular to the installation plane of the apparatus body.

In FIG. 8, a plurality of printing media P are arranged generally in the vertical direction parallel to each other in the interior of a paper-feeding region 81. These printing media P in a stack form are brought into press-contact with a presser plate 82 by compressive springs 83 as shown in the drawing.

When the printing media P are fed, each printing medium is conveyed one by one by the cooperation of a separating pawl (not shown) and a pickup roller 4 into the printing apparatus.

According to this embodiment in which the printing medium is disposed generally in the vertical direction, the paper-feeding region is disposed within the projected image of the paper-discharging region, and thus, space saving of the overall apparatus body is achievable as in the second embodiment.

Figure 9:
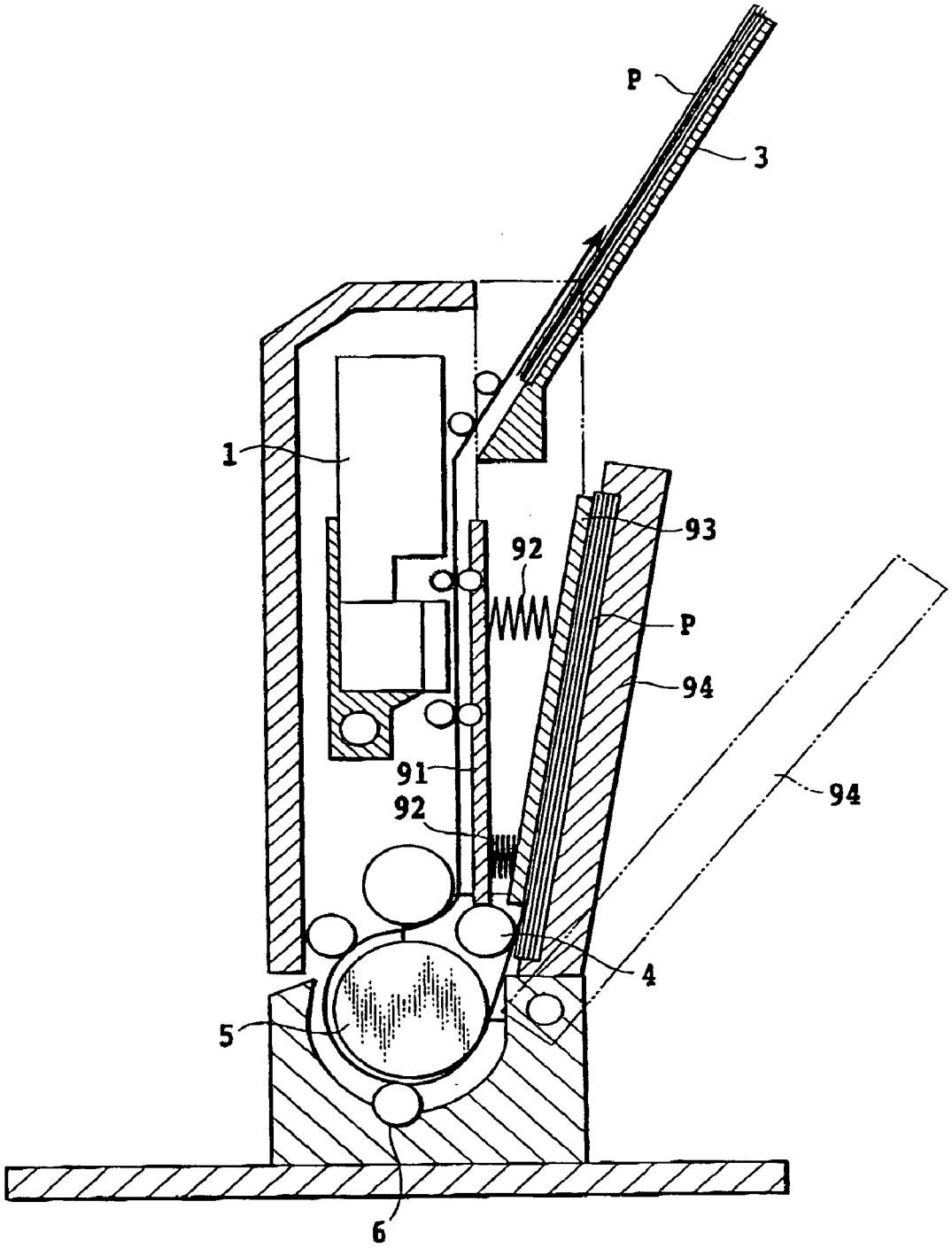
FIG. 9 is a sectional view of a modification of the ink jet printing apparatus to which the third embodiment of the present invention is applied.

FIG. 9 is a sectional view of a further improved modification of the above embodiment.

In FIG. 9, reference numeral 91 denotes a platen. The platen 91 in this modification is longer than those of the two embodiments described above and that shown in FIG. 8 and extends in the vertical direction close to the pickup roller 4. At a position opposed to the platen 91, there is a presser plate 93 having a length generally equal to that of the platen 91. Between the platen 91 and the presser plate 93, there are compressive springs 92. A paper-feeding region 94 is a cassette or a tray capable of storing a stack of printing media, and is tiltable to a position shown by a chain line when the printing medium is supplied.

During the printing, the paper-feeding region 94 is disposed in the vertical direction. At this time, the presser springs 92 serve to press the printing media stored in the paper-feeding region and push the platen 91 from rear side.

The arrangement shown in FIG. 9 is effective not only for reducing a size relative to the installation plane, but also for preventing paper-blocking. That is, when the printing medium blocks the conveying path, it is possible to release a spring pressure applied to the paper-feeding region 94 and the platen 91 while using an openable system of the paper-feeding region 94 so that the blocked printing medium is immediately removable. At this time, since the printing medium is discharged from the platen side, contamination by the contact of a user's hand with the printing head or damage of the printing head can be reduced.

As described hereinabove, according to the present invention, since the conveying path of the printing medium is guided generally in the vertical direction and the printing medium is supported more firmly, it is possible to reduce the installation area for the printing apparatus while conveying the printing medium in a stable manner. Also, contamination in the interior of the apparatus due to ink becomes less likely so that a printing apparatus excellent in reliability is provided.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus for introducing a printing medium from a first printing medium holding region and discharging the printing medium after being printed to a second printing medium holding region disposed above the first printing medium holding region, the first printing medium holding region and the second printing medium holding region being disposed on a first side of an apparatus body, comprising:

paper-feeding means for conveying the printing medium from the first printing medium holding region;

reversal means for reversing the conveying direction of the printing medium conveyed by said paper-feeding means generally in the reverse direction, said reversal means including a reversal roller having a peripheral surface which is in close proximity to both of the first side of the apparatus body and a second side of the apparatus body opposite to the first side;

deflection means for deflecting the printing medium reversed by said reversal means such that the printing medium advances upward generally in the vertical direction in the vicinity of the first side of the apparatus body, the printing medium being conveyed between said paper-feeding means and the second printing medium holding region;

holding means for holding printing means such that the printing means is held at a position where the printing means is directly over said reversal means; and paper-discharging means for discharging the printing medium on which the record is printed by the printing means to the second printing medium holding region, wherein the printing means is located above said paper-feeding means, wherein the printing means performs printing by ejecting inks onto the printing medium that is guided by said deflection means so as to advance upwardly generally in the vertical direction, wherein an ink tank, for storing ink that is to be supplied to the printing means, is arranged above the printing means, and wherein the printing medium is conveyed between the ink tank and the first side of the apparatus body above the printing means in a manner such that the printing medium is conveyed along the ink tank and the first side of the apparatus body in the vicinity of the first side of the apparatus body.

2. A printing apparatus as claimed in claim 1, wherein the printing means is held within a minimum frame encircling said reversal means, said deflection means and said paper-discharging means.

3. A printing apparatus as claimed in claim 1, wherein all constituent members except for the first printing medium holding region and the second printing medium holding region are disposed within the interior of an outer case member of a generally parallelepiped-shape, and the first printing medium holding region and the second printing medium holding region are provided on the same side of the outer case member.

4. A printing apparatus as claimed in claim 3, wherein a length of a shorter side of a rectangular installation plane of the outer case member is shorter than a height of the outer case member.

5. A printing apparatus as claimed in claim 4, wherein the length of the shorter side of the rectangular installation plane of the outer case member is 100 mm or less, and the height of the outer case member is 400 mm or less.

6. A printing apparatus as claimed in claim 1, wherein the printing means is held generally above said reversal means in the vertical direction, and in a space between the printing means and said reversal means, a conveying path for the printing medium is disposed.

7. A printing apparatus as claimed in claim 1, wherein the reversal roller rotates about an axis thereof while being in tight contact on the peripheral surface thereof with the printing medium, whereby the printing medium is conveyed while being wrapped around 90 degrees or more of the peripheral surface of the reversal roller.

8. A printing apparatus as claimed in claim 1, wherein either one of the first printing medium holding region or the second printing medium holding region, disposed at a lower position when the printing apparatus is used, is mounted on the printing apparatus at a greater angle relative to the horizontal plane.

9. A printing apparatus as claimed in claim 1, wherein a stack of printing media in the first printing medium holding region is held at a vertical position by a flat presser member when the printing apparatus is used.

10. A printing apparatus as claimed in claim 1, wherein said paper-discharging means discharges the printing medium above a lower end of the second printing medium holding region when the printing apparatus is used.

11. A printing apparatus as claimed in claim 1, wherein the printing means comprises a printing head for printing on the printing medium while moving in the horizontal direction during use.

12. A printing apparatus for introducing a printing medium from a first printing medium holding region and discharging the printing medium after being printed to a second printing medium holding region disposed below the first printing medium holding region, the first printing medium holding region and the second printing medium holding region being disposed on a first side of an apparatus body, comprising:

paper-feeding means for conveying the printing medium from the first printing medium holding region;

deflection means for deflecting the printing medium conveyed by said paper-feeding means such that the printing medium advances downward generally in the vertical direction in the vicinity of the first side of the apparatus body, the printing medium being conveyed between said paper-feeding means and the second printing medium holding region;

holding means for holding printing means having an ink tank;

reversal means for reversing the conveying direction of the printing medium on which an image has been printed in a direction toward a position at which the second printing medium holding region is located after being drawn generally in the direction opposite to the position at which the second printing medium holding region is located, said holding means holding the printing means such that the printing means is held at a position where the printing means is directly over said reversal means, said reversal means including a reversal roller having a peripheral surface which is in close proximity to both of the first side of the apparatus body and a second side of the apparatus body opposite to the first side; and paper-discharging means for discharging the printing medium, which has been deflected in the direction toward the position at which the second printing medium holding region is located, into the second printing medium holding region, wherein the printing medium is conveyed between the ink tank and the first side of the apparatus body above the printing means in a manner such that the printing medium is conveyed along the ink tank and the first side of the apparatus body in the vicinity of the first side of the apparatus body.

13. A printing apparatus as claimed in claim 12, wherein the printing means comprises a printing head capable of ejecting ink to the printing medium.

14. An image-forming apparatus for printing on a printing medium by using an ink jet printing head, comprising:

a paper-feeding tray disposed on a first side of a body of the image-forming apparatus while stacking the printing media therein at a slanted position so that a portion of said tray closer to the apparatus body is relatively lower;

a pickup roller for feeding the printing medium stacked in said paper-feeding tray;

a reversal path for reversing the printing medium fed by said pickup roller by guiding the printing medium closer to a second side opposite to the first side, and then guiding the printing medium closer to the first side;

a paper-discharging tray disposed above said paper-feeding tray on the first side, and capable of stacking printing media;

a conveying path for guiding the printing medium guided along said reversal path between said paper-feeding tray and said paper-discharging tray generally upwardly in the vicinity of the first side;

holding means for holding the ink jet printing head at a position where the printing head is directly over said reversal path so that the ink jet printing head effects recording on the printing medium guided along said conveying path; and a discharging roller for discharging the printing medium on which printing has been effected by the ink jet printing head to said paper-discharging tray, wherein an ink tank disposed above or below the ink jet printing head, for storing ink therein to be supplied to the ink jet printing head, is held by the ink jet printing head or said holding means, wherein an openable member is provided on the second side to allow access to the ink jet printing head, wherein the ink jet printing head is arranged above said pickup roller, and wherein the printing medium is conveyed between said ink tank and the first side of said apparatus body above said printing means in a manner such that the printing medium is conveyed along said ink tank and the first side of said apparatus body in the vicinity of the first side of said apparatus body.

* * * * *

UNITED STATES PATENT AND TRADEMARK OFFICE

CERTIFICATE OF CORRECTION

PATENT NO. : 7,021,755 B2
APPLICATION NO. : 10/671522
DATED : April 4, 2006
INVENTOR(S) : Hideki Ogura et al.

It is certified that error appears in the above-identified patent and that said Letters Patent is hereby corrected as shown below:

IN THE DRAWINGS

Sheet 1, Fig. 1A, "FIG. 1A" should read --FIG. 1A PRIOR ART--.

COLUMN 4

Line 52, "ing" should read --ing:--.

Signed and Sealed this

First Day of April, 2008

JON W. DUDAS
*Director of the United States Patent and Trademark Office*